US007436364B2

(12) United States Patent
Nishikido et al.

(10) Patent No.: US 7,436,364 B2
(45) Date of Patent: Oct. 14, 2008

(54) MOBILE RADIO APPARATUS

(75) Inventors: Tomoaki Nishikido, Komatsu (JP); Yutaka Saito, Nomi-gun (JP); Hiroshi Haruki, Yokohama (JP); Yoshio Koyanagi, Ebina (JP); Kiyoshi Egawa, Minato-ku (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 176 days.

(21) Appl. No.: 10/576,449

(22) PCT Filed: Oct. 6, 2004

(86) PCT No.: PCT/JP2004/014752

§ 371 (c)(1),
(2), (4) Date: Apr. 20, 2006

(87) PCT Pub. No.: WO2005/041350

PCT Pub. Date: May 6, 2005

(65) Prior Publication Data

US 2007/0080872 A1 Apr. 12, 2007

(30) Foreign Application Priority Data

Oct. 23, 2003 (JP) ..... 2003-363809

(51) Int. Cl.
*H01Q 1/24* (2006.01)

(52) U.S. Cl. ..... 343/702

(58) Field of Classification Search ..... 343/702, 343/700 MS, 872, 824–826, 878, 895, 898, 343/770

See application file for complete search history.

(56) References Cited

U.S. PATENT DOCUMENTS 5,420,599 A * 5/1995 Erkocevic ..... 343/828

(Continued)

FOREIGN PATENT DOCUMENTS

EP 1168658 1/2002

(Continued)

OTHER PUBLICATIONS

Supplementary European Search Report dated Sep. 6, 2006.

(Continued)

*Primary Examiner*—Huedung Cao Mancuso
(74) *Attorney, Agent, or Firm*—Dickinson Wright, PLLC

(57) ABSTRACT

A mobile radio apparatus that achieves high radiation efficiency in various usage states of a foldable mobile radio apparatus without causing negative impact on communication, and that can realize a thin model. In this mobile radio apparatus that is foldable and that has a mechanism joining a first case and second case at a hinge part and allowing the mobile radio apparatus to open and close, flat conductor (104), flat conductor (106) and flat conductor (107) that are placed distant from flat conductor (104) are placed in the first case, gravity sensor (122) detects an inclination angle of the mobile radio apparatus to judge the usage state of the mobile radio apparatus, and control section (123) controls high frequency switch (112) according to the inclination angle and supplies power selectively to flat conductor (106) and flat conductor (107). Furthermore, power is constantly supplied to flat conductor (104) during communication at a different phase from the phase power is supplied to flat conductor (106) or flat conductor (107).

6 Claims, 13 Drawing Sheets

U.S. PATENT DOCUMENTS

| | | | | |
|---|---|---|---|---|
| 5,926,150 | A * | 7/1999 | McLean et al. | 343/846 |
| 6,166,694 | A * | 12/2000 | Ying | 343/702 |
| 6,326,921 | B1 * | 12/2001 | Egorov et al. | 343/700 MS |
| 6,529,749 | B1 | 3/2003 | Hayes et al. | |
| 6,731,920 | B1 | 5/2004 | Iwai et al. | |
| 6,919,861 | B2 | 7/2005 | Miyano | |
| 7,148,852 | B2 * | 12/2006 | Pathak et al. | 343/702 |
| 2002/0058483 | A1 | 5/2002 | Shinichi et al. | |
| 2005/0057405 | A1 * | 3/2005 | Horibe | 343/702 |

FOREIGN PATENT DOCUMENTS

| | | |
|---|---|---|
| JP | 8288895 | 11/1996 |
| JP | 9214237 | 8/1997 |
| JP | 10224142 | 8/1998 |
| JP | 11284424 | 10/1999 |
| JP | 2000349525 | 12/2000 |
| JP | 2001156898 | 6/2001 |
| JP | 2001292017 | 10/2001 |
| JP | 2002064314 | 2/2002 |
| JP | 2002152115 | 5/2002 |
| JP | 2003133991 | 5/2003 |
| WO | 0176009 | 10/2001 |
| WO | 03/023955 | 3/2003 |

OTHER PUBLICATIONS

PCT International Search Report dated Nov. 9, 2004.
Japanese Office Action dated Nov. 13, 2007 with English Translation thereof.

* cited by examiner

PHASE DIFFERENCE = 90 DEGREES

PHASE DIFFERENCE = 270 DEGREES

PHASE DIFFERENCE = 180 DEGREES

PHASE DIFFERENCE = 0 DEGREE

MOBILE RADIO APPARATUS

TECHNICAL FIELD

The present invention relates to mobile radio apparatus such as mobile telephones. More particularly, the present invention relates to a mobile radio apparatus where a first case and second case are joined at a hinge part and can be open and closed.

BACKGROUND ART

Foldable mobile telephones widely used in recent years generally have a mechanism joining an upper case and lower case at a hinge part allowing the foldable mobile telephones to open and close. Furthermore, many terminals in lately released mobile telephones place importance on design, incorporate antennas and pursue thinness. (for example, refer to Patent Document 1.)

In case a user makes a call using such a mobile telephone, the state where the user holds the mobile telephone with a hand and places it close to the ear (hereinafter referred to as "calling state") is common. In case the user performs communication such as e-mail or video phone, the state where the user operates the mobile telephone by holding it in front of the chest with a hand (hereinafter referred to as "operating state") is common. In these various usage states, to maintain good communication quality, there is a technology of antenna switching diversity that provides a plurality of antennas at the comparatively distant parts on a mobile telephone and switches antennas in accordance with the usage states (for example, refer to Patent Document 2).

In antenna switching diversity system, antenna becomes temporary unconnected (open) at the moment antennas switch during communication, and antenna gain fluctuates substantially before and after switching. In TDMA system, switching diversity operation is implemented in the guard time other than the slot which is necessary for communication, and therefore the momentary disconnection and gain fluctuation of an antenna are not a problem.

Patent Document 1: Laid-Open Japanese Patent Publication No.2001-156898

Patent Document 2: Laid-Open Japanese Patent Publication No.2002-64314

DISCLOSURE OF INVENTION

Problems to be Solved by the Invention

However, in code division multiple access (CDMA) system, consecutive transmission processing or transmit power control is generally implemented at the mobile radio apparatus side, and, therefore, when antenna gain deteriorates by switching antennas during communication, this may cause negative impact on communication.

Furthermore, the technique disclosed in Patent Document 1 has no means that controls antenna directivity, and therefore has a problem that the radiation to the human body is high in the calling state and operating state and antenna radiation efficiency is likely to deteriorate.

The technique disclosed in Patent Document 2 has a problem that, although it is possible to change directivity by performing phase control in the state where a flip is open, it is not possible to change directivity in the state the flip is closed, and therefore antenna radiation efficiency is likely to deteriorate and the design aspect of the mobile telephone is lost with a helical antenna sticking out.

It is therefore an object of the present invention to provide a thin mobile radio apparatus which achieves high antenna radiation efficiency without causing negative impact on communication in various usage states of the foldable mobile radio apparatus.

Means for Solving the Problem

The mobile radio apparatus according to the present invention is a mobile radio apparatus that is foldable and that has a mechanism joining a first case and second case at a hinge part allowing the mobile radio apparatus to open and close and adopts a configuration having a first flat conductor placed on a first plane inside the first case along a length direction of the first case, and a second flat conductor and third flat conductor placed on a second plane facing a first plane inside the first case along the length direction of the first case, and a power supply section that supplies power to the first flat conductor and supplies power selectively to the second flat conductor or the third flat conductor at a different phase from the phase power is supplied to the first flat conductor.

According to this configuration, by supplying power to the first flat conductor and selectively supplying power to the second flat conductor or the third flat conductor at a different phase from the phase power is supplied to the first flat conductor, directivity is formed and therefore when the phase is adjusted not to direct to the human body, it is possible to suppress radiation to the human body and increase antenna radiation efficiency. Furthermore, power is constantly supplied to the first flat conductor, and therefore when the usage state of a mobile radio apparatus changes during communication in communication scheme that transmits consecutively, it is possible to avoid causing negative impact on communication.

Advantageous Effect of the Invention

According to the present invention, by placing at least two flat conductors in the first case of a foldable mobile radio apparatus that has a mechanism joining a first case and second case at a hinge part and allowing the mobile radio apparatus to open and close, and by constantly supplying power to one flat conductor and supplying the other flat conductor having a phase difference, it is possible to achieve high antenna radiation efficiency and high effective gain in various usage states of a mobile radio apparatus without causing negative impact on communication in CDMA system, and realize a thinner mobile radio apparatus.

BEST MODE FOR CARRYING OUT THE INVENTION

Embodiments of the present invention will be described in detail below with reference to the accompanying drawings.

Embodiment 1

Figure 1A:
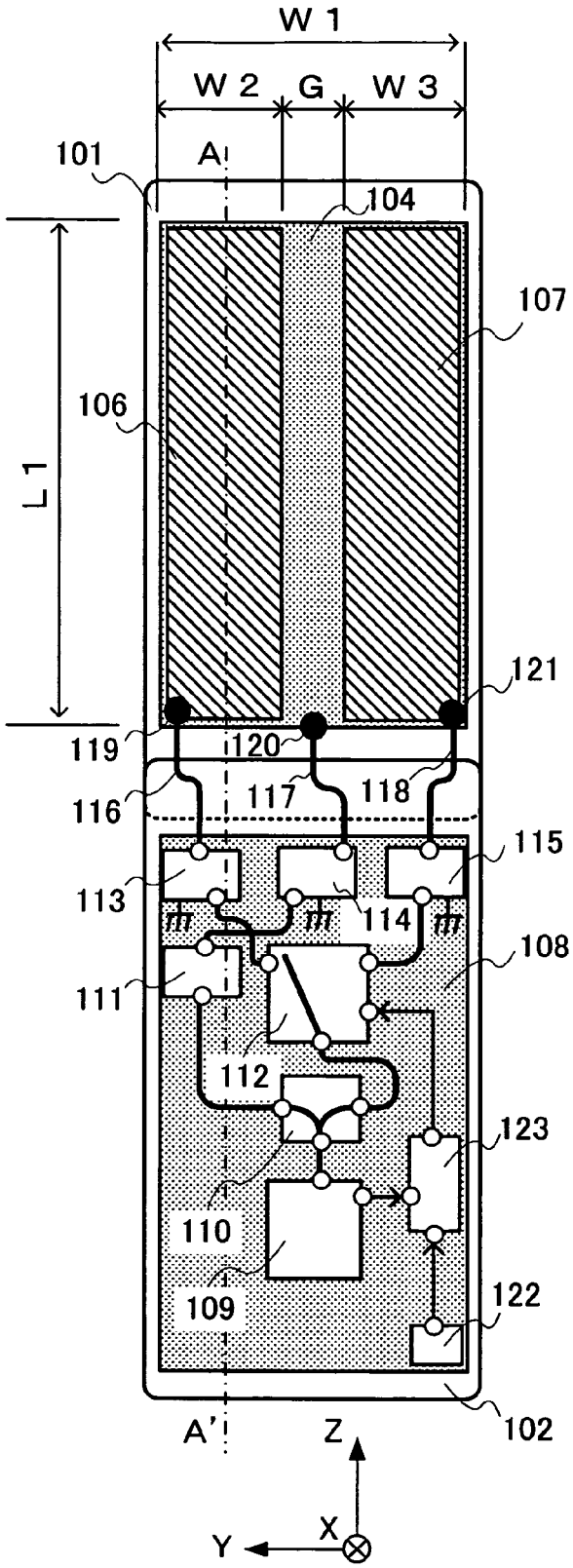
FIG. 1A is a rear view showing a configuration of a mobile radio apparatus according to Embodiment 1 of the present invention.
Figure 1B:
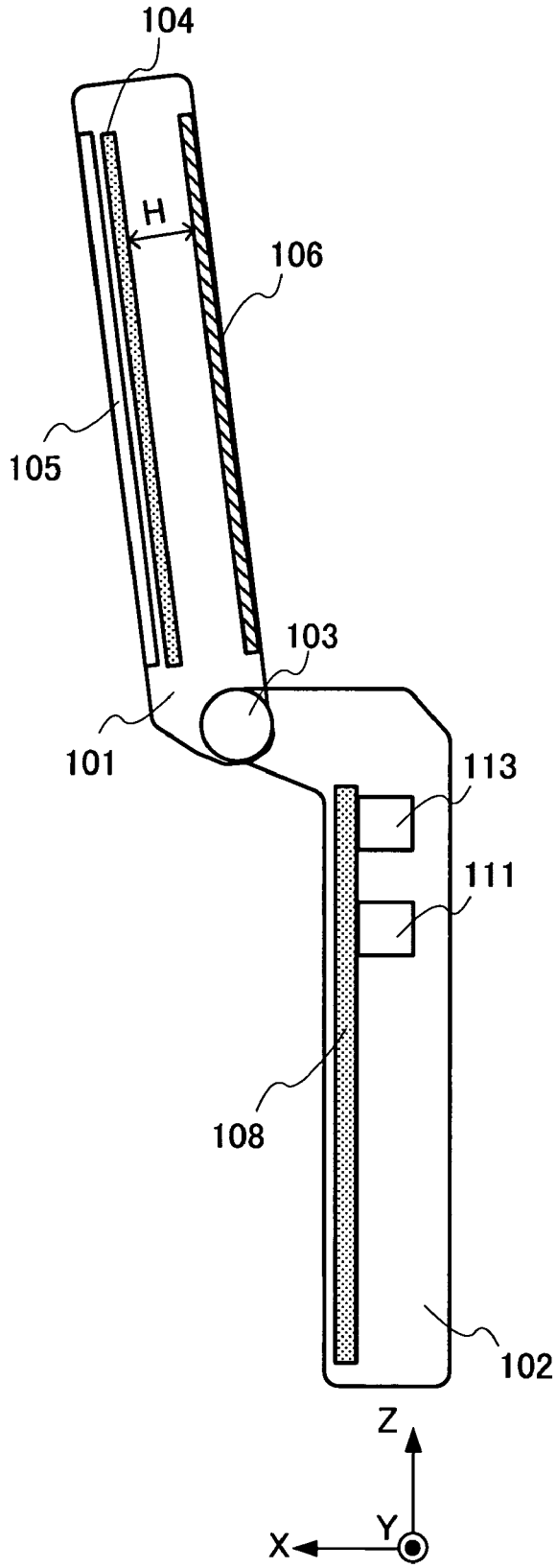
FIG. 1B is a cross sectional view showing a configuration of the mobile radio apparatus according to Embodiment 1 of the present invention.

FIG. 1A and FIG. 1B are views showing configurations of a mobile radio apparatus according to Embodiment 1 of the present invention. These figures illustrate a state where the foldable mobile radio apparatus is open (hereinafter referred to as "open state"). FIG. 1A is a rear view of the mobile radio apparatus and FIG. 1B is a (A-A') cross sectional view of FIG. 1A.

Upper case 101 as a first case and lower case 102 as a second case are made from resin which is an insulator, and generally set to be at a length of about 100 mm and width of about 50 mm. Upper case 101 and lower case 102 are joined rotatably at hinge part 103, thereby forming a foldable configuration.

Flat conductor 104 is, for example, made of a copper plate having a length L1 of about 70 mm and width W1 of about 45 mm, and is placed inside upper case 101 along display section 105 such as LCD set.

Flat conductor 106 and flat conductor 107 are, for example, made of a copper plate having a length L1 of about 70 mm and width W2 and W3 of about 20 mm, are placed inside upper case 101 along the opposite plane of display section 105. Gap G between flat conductor 106 and flat conductor 107 is, for example, set to 5 mm. Gap H between flat conductor 106, flat conductor 107 and flat conductor 104 is, for example, set to 5 mm. The thickness of flat conductor 104, flat conductor 106 and flat conductor 107 is set to about 0.1 mm, and they are placed not to structurally interfere with other components such as display elements inside thin upper case 101, which is, for example, 7 mm thick.

Ground plate 108 is, for example, a conductor plate having a length of about 90 mm and width of about 45 mm. Generally ground pattern of the circuit placed inside lowercase 102 is used. On ground plate 108, ground pattern which is ground potential of circuit is formed in almost whole area.

Radio circuit 109 has a receiving circuit and transmitting circuit, measures received power at the receiving circuit, and reports the measured received power to control section 123. Radio circuit 109 supplies power to matching circuit 114 through power divider 110 and phase shifter 111, and also supplies power to matching circuit 113 or matching circuit 115 through power divider 110 and high frequency switch 112.

Power divider 110 is, for example, configured with a Wilkinson circuit and divides high frequency signals output from radio circuit 109 by the same amplitude and the same phase, outputs one to phase shifter 111, and outputs the other to high frequency switch 112.

Phase shifter 111 is, for example, a circuit configured with lumped parameter element or distributed parameter element, makes the value of the phase of high frequency signal supplied to matching circuit 113 or matching circuit 115 different from the value of the phase of high frequency signal supplied to matching circuit 114.

High frequency switch 112 is, for example, configured with FET (Field Effect Transistor) or PIN diode, selects to matching circuit 113 and matching circuit 115 to supply power, according to control signal of control section 123

Matching circuit 113, matching circuit 114 and matching circuit 115 coordinate impedance of flat conductor 104, flat conductor 106 and flat conductor 107 with the circuit impedance of radio circuit 109 (generally 50Ω.) Ground potential of each matching circuit is grounded to ground pattern on ground plate 108.

Power supply point 120 is provided in the lower part of flat conductor 104 and is electrically connected to matching circuit 114 through power supply line 117, and power supply point 119 and power supply point 121 are provided in the lower part of flat conductor 107 and are electrically connected to matching circuit 113 and matching circuit 115 respectively through power supply line 116 and power supply line 118. Power supply line 116, power supply line 117 and power supply line 118 are made of flexible wire material, and by this means, upper case 101 becomes rotatable at hinge part 103.

Gravity sensor 122 detects the inclination angle of the mobile radio apparatus and reports the detected inclination angle to control section 123. The inclination angle is, for example, an angle of inclination toward a direction of gravity. Control section 123 controls high frequency switch 112 by the inclination angle reported from gravity sensor 122 or the reception level reported from radio circuit 109.

By having this configuration, flat conductor 104 and flat conductor 106 or flat conductor 107 and ground plate 108 operate as a dipole antenna where power is supplied at the same time at different phases.

Next, antenna operation of a foldable mobile radio apparatus having the above configuration will be explained. Here, the operation will be explained with operating frequency set at 2.14 GHz.

Figure 2:
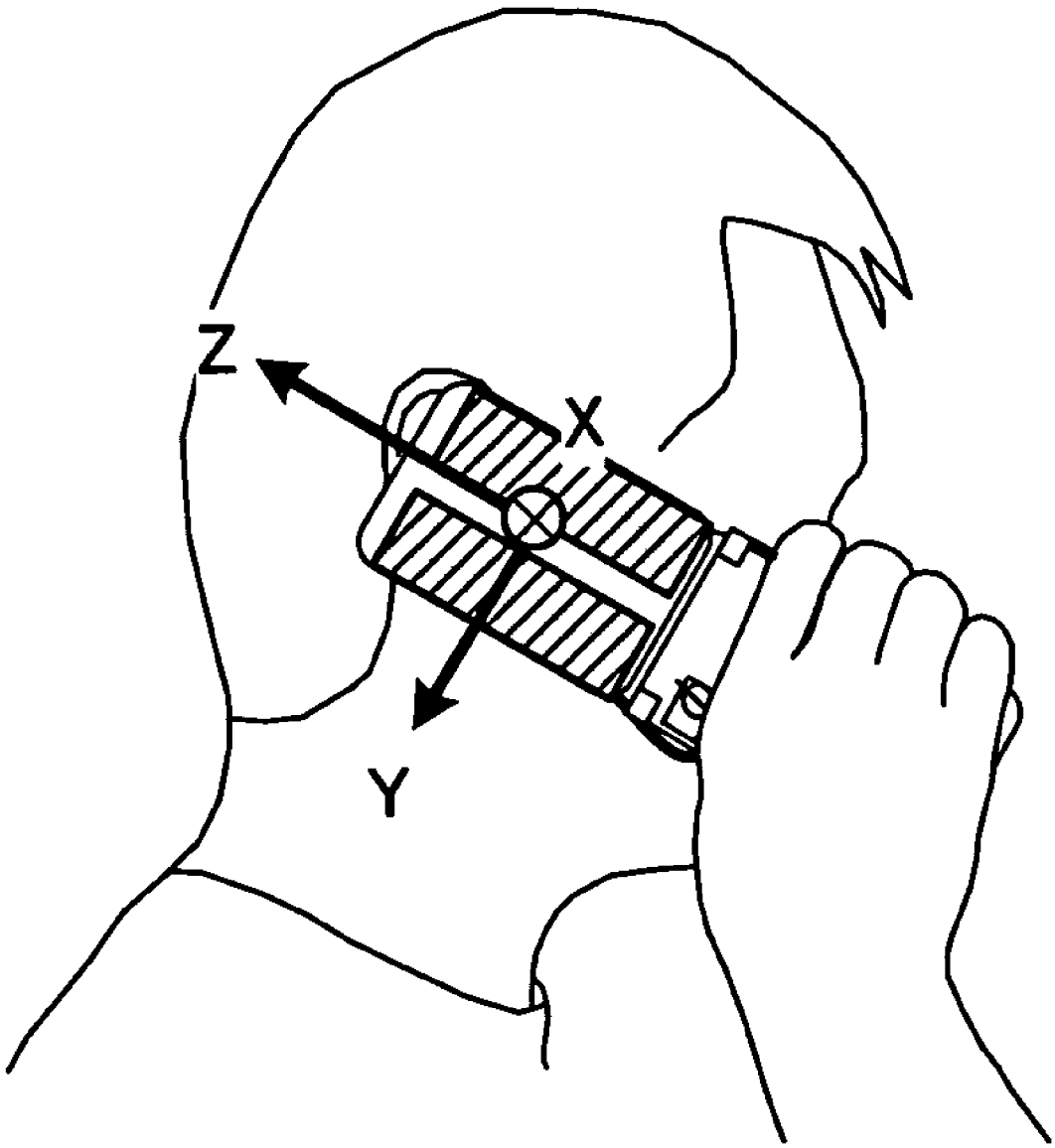
FIG. 2 illustrates a calling state where the user holds the mobile radio apparatus with a hand.

First, the calling state where the user holds the foldable mobile radio apparatus with a hand will be explained. FIG. 2 is a view showing the calling state. This figure illustrates a state where the user holds the mobile telephone with the right hand and places it close to the ear.

Here, for example, in case the user holds the mobile telephone with the right hand and makes a call, gravity sensor 122 detects the angle the mobile radio apparatus is inclined (inclination angle) and reports this angle information to control section 123.

Control section 123 outputs the signal selecting flat conductor 107 to high frequency switch 112 based on the angle information reported from gravity sensor 122, and high frequency switch 112 is switched to supply power to matching circuit 115. Phase shifter 111 gives the phase of the high frequency signal supplied to matching circuit 114 through phase shifter 111 from power divider 110 a 270-degree lag (or a 90-degree lead) with respect to the phase of a high frequency signal supplied to matching circuit 115. Here, power supply point 119 of flat conductor 106, which is not selected, has a predetermined impedance (for example, an open state.)

Figure 3A:
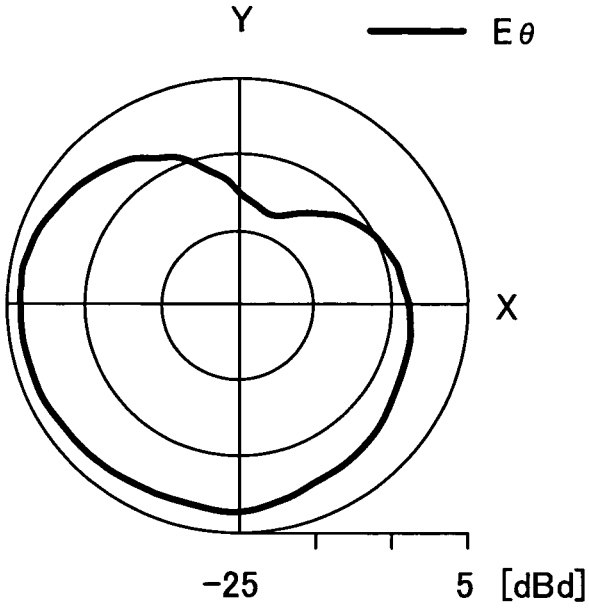
FIG. 3A is a radiation pattern view showing vertically polarized wave components on an X-Y plane.
Figure 3B:
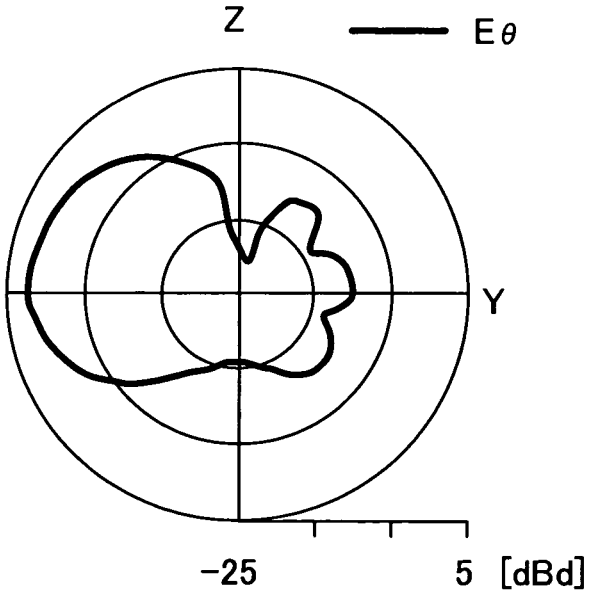
FIG. 3B is a radiation pattern view showing vertically polarized wave components on an Y-Z plane.

In this case, radiation pattern in coordinate system of FIG. 1A and FIG. 1B is shown in FIG. 3A and FIG. 3B. FIG. 3A illustrates vertically polarized wave components (Eθ) on the X-Y plane, and FIG. 3B illustrates vertically polarized wave components (Eθ) on the Y-Z plane. In case of supplying power to flat conductor 104 and flat conductor 107 with a phase difference as described above, directivity can be controlled to increase gain in −X and −Y directions. That is, in case of the calling state shown in FIG. 2, where the user holds the mobile telephone with the right hand, directivity can be controlled in opposite directions from the head and shoulder, and high radiation efficiency of −4 dB can be achieved, and compared to the case that directivity is not controlled, radiation efficiency at the calling state can be increased 2 dB.

On the other hand, in case that the user makes a call with the mobile telephone held with the left hand (not shown), based on the result of angle detection by gravity sensor 122, high frequency switch 112 is controlled by control section 123, flat conductor 106 is selected, and power is supplied to matching circuit 113. Control section 123 controls the phase at phase shifter 111 so that the phase of high frequency signal supplied to matching circuit 114 gives a 270-degree lag (or a 90-degree lead) with respect to the phase of high frequency signal supplied to matching circuit 113.

Figure 4A:
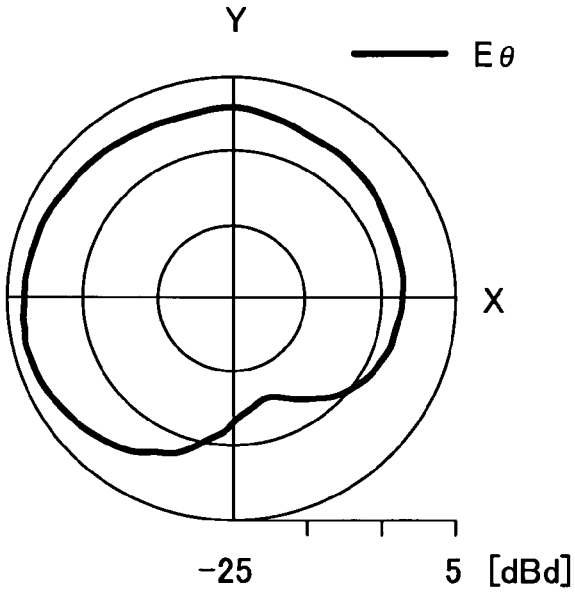
FIG. 4A is a radiation pattern view showing vertically polarized wave components on an X-Y plane.
Figure 4B:
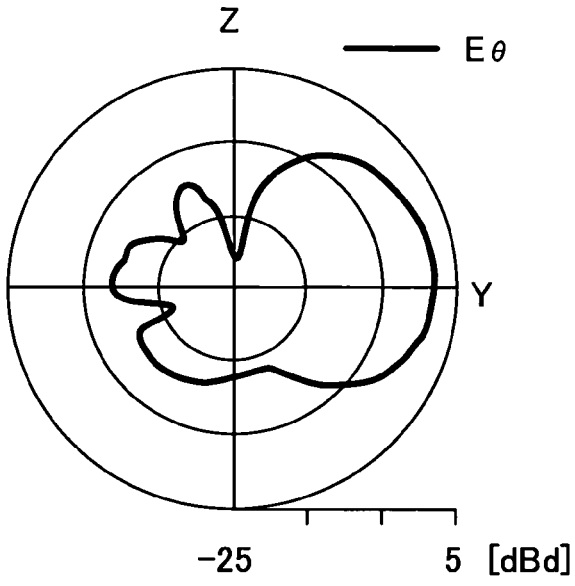
FIG. 4B is a radiation pattern view showing vertically polarized wave components on an Y-Z plane.

In this case, radiation patterns in coordinate system of FIG. 1A and FIG. 1B are shown in FIG. 4A and FIG. 4B. FIG. 4A illustrates vertically polarized wave components (Eθ) on the X-Y plane, and FIG. 4B illustrates vertically polarized wave components (Eθ) on the Y-Z plane. As shown in this figure, directivity can be controlled in −X and +Y directions. That is, in case of the calling state where the user holds the mobile telephone with the left hand, directivity can be controlled in opposite directions from the head and shoulder and high radiation efficiency of −4 dB can be achieved, and compared to the case where directivity is not controlled, radiation efficiency at the calling state can be increased 2 dB.

Figure 5:
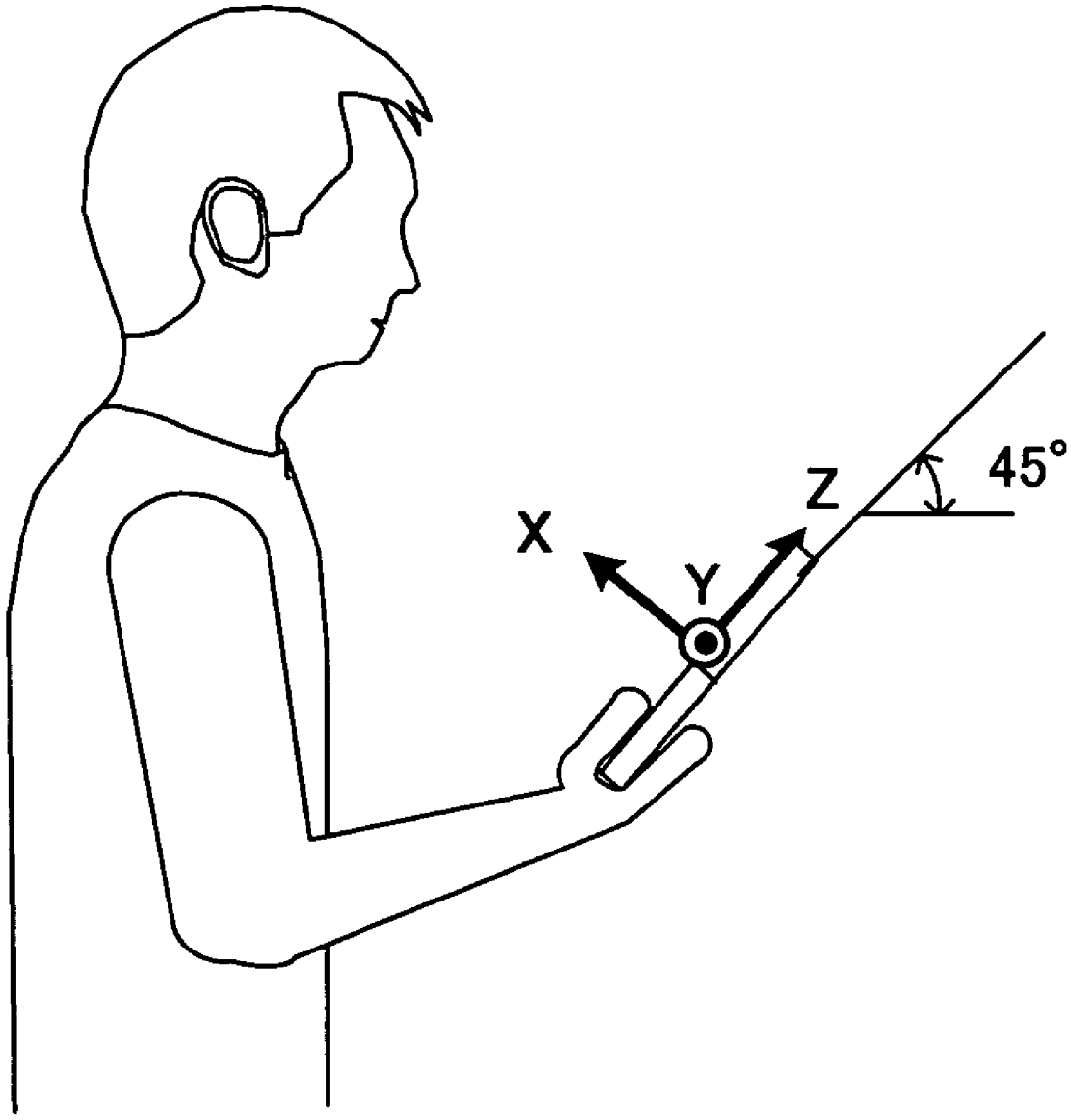
FIG. 5 illustrates an operating state where the user holds the mobile radio apparatus with a hand.

Next, an operating state will be explained where the user holds the foldable mobile radio apparatus with the right or left hand and operates key panels with fingers. FIG. 5 illustrates the operating sate.

In this case, gravity sensor 122 detects an inclination angle of the mobile radio apparatus and reports the angle information to control section 123. Control section 123 selects to flat conductor 106 and flat conductor 107 based on the angle information reported from gravity sensor 122. Whichever flat conductor is selected, directivity can be controlled in opposite directions from the human body, and therefore radiation efficiency at the operating state is increased −2 dB.

Here, for example, in case that flat conductor 106 is selected and the user's fingers touch the location where flat conductor 106 is placed, radiation from flat conductor 106 considerably decreases and radiation is from flat conductor 104, and therefore radiation efficiency decreases about 2.5 dB.

At this point, control section 123 judges that reception level reported from radio circuit 109 has decreased and performs a control of switching high frequency switch 112 to supply power to flat conductor 107, and therefore the decreased radiation efficiency is improved 2 dB and communication performance is improved.

With the mobile radio apparatus of this embodiment, flat conductor 104 is connected even at the moment that high frequency switch is switched to control directivity, and at no time are all antenna elements open. Therefore, negative impact is not caused on communication in CDMA system that performs a continuous transmit operation or a transmit power control at the mobile radio apparatus side.

According to this embodiment, it is possible to achieve high antenna radiation efficiency in various usage states without causing negative impact on communication in CDMA system by detecting an inclination angle according to the usage state of the foldable mobile radio apparatus, supplying power selectively to flat conductor 106 or flat conductor 107 based on the detected inclination angle, and supplying power to flat conductor 104 with a signal having a predetermined phase difference to the phase exciting flat conductor 106 or flat conductor 107.

In this embodiment, a metal frame which configures part of upper case 101, a circuit board placed inside upper case 101, or a flat conductive element of dedicated use for antenna elements can be used as flat conductor 104.

A case has been described with this embodiment where when the user's fingers touch the location of the flat conductor and reception level decreases in the operating state, the decrease of reception level is detected and the flat conductor is switched to another flat conductor, by performing the same operation in the calling state, it is also possible to suppress the decrease of radiation efficiency to a minimum (1 dB.)

Embodiment 2

Figure 6A:
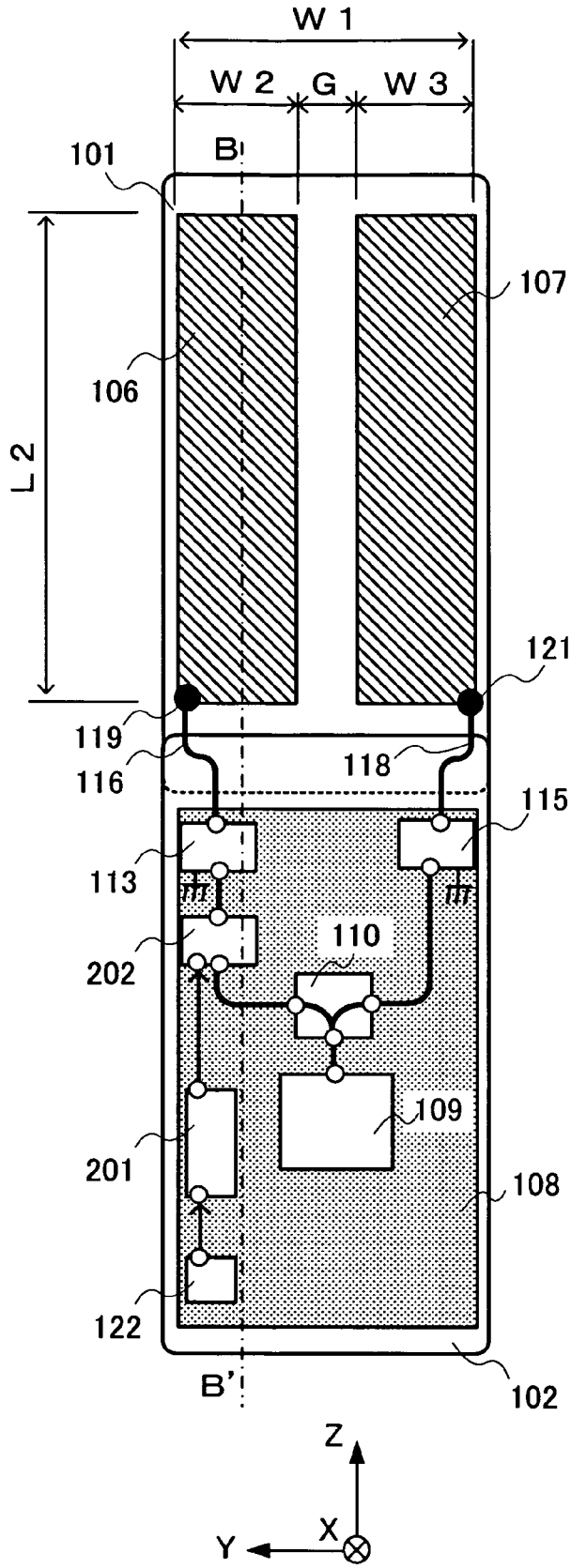
FIG. 6A is a rear view showing a configuration of the mobile radio apparatus according to Embodiment 2 of the present invention.
Figure 6B:
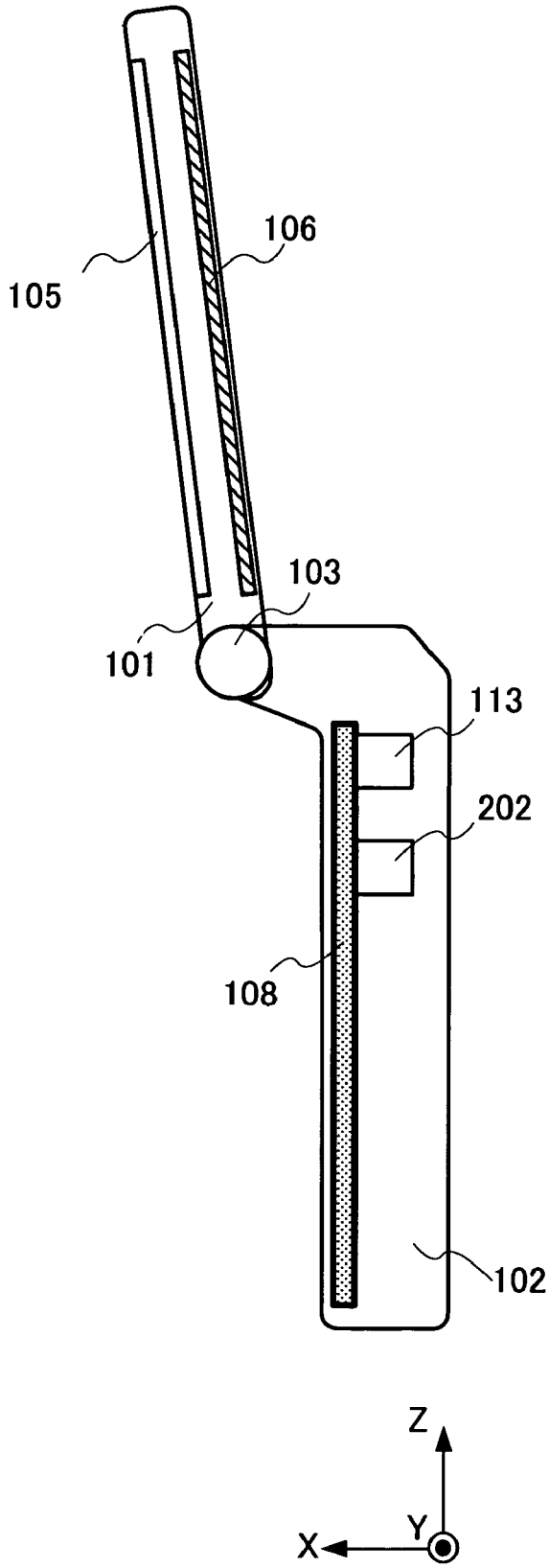
FIG. 6B is a cross sectional view showing a configuration of the mobile radio apparatus according to Embodiment 2 of the present invention.

FIG. 6A and FIG. 6B are views showing configurations of a mobile radio apparatus according to embodiment 2. This figure illustrates an open state of the foldable mobile radio apparatus. FIG. 6A is a rear view of the mobile radio apparatus and FIG. 6B is a B-B' cross sectional view of FIG. 6A. The same codes as FIG. 1A and FIG. 1B are assigned to parts in FIG. 6A and FIG. 6B which are common with parts in FIG. 1A and FIG. 1B, and detailed explanation thereof is omitted.

In FIG. 6A and FIG. 6B, gravity sensor 122 detects the inclination angle of the mobile radio apparatus and reports the detected inclination angle to control section 201. Control section 201 controls phase shifter 202 in accordance with the reported inclination angle from gravity sensor 122.

Phase shifter 202 changes the phase of a high frequency signal supplied to matching circuit 113 based on a control signal from control section 201. That is, the phase of a high frequency signal supplied to matching circuit 113 has a phase difference from the phase of a high frequency signal supplied to matching circuit 115. Therefore, it is possible to control directivity consecutively by changing the phase power is supplied consecutively in accordance with angle detection results from gravity sensor 122. This makes it possible to suppress the decrease of antenna gain and avoid having negative impact on communication in case that the usage state changes during communication in CDMA system.

Next, antenna operation of the foldable mobile radio apparatus comprising above configuration will be explained. First, at the calling state where the user holds the mobile radio apparatus with the right hand shown in FIG. 2, gravity sensor 122 detects the angle the mobile telephone is inclined (inclination angle) and reports the angle information to control section 201.

Figure 7A:
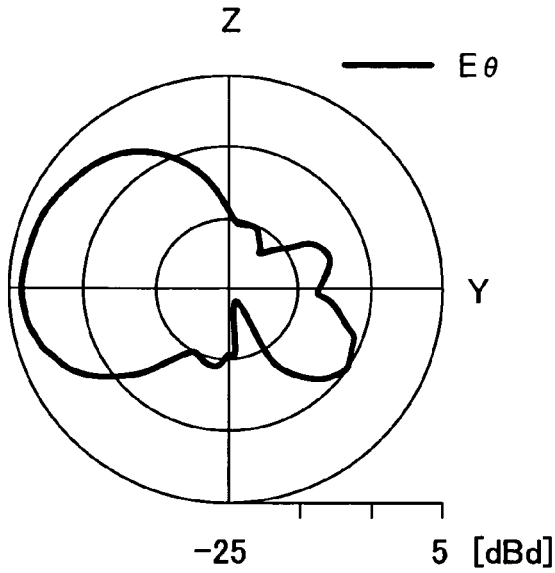
FIG. 7A illustrates a view of radiation pattern at a phase difference of 90 degrees.

Control section 201 controls phase shifter 202 so that the phase of a high frequency signal supplied to matching circuit 113 gives a 90-degree lag with respect to the phase of a high frequency signal supplied to matching circuit 115. In this case, radiation pattern is as shown in FIG. 7A and it is possible to control directivity in −Y direction. Therefore, in the case of the calling state where the user holds a mobile radio apparatus with the right hand, it is possible to control directivity in opposite directions from the shoulder and improve the radiation efficiency about 0.7 dB which is approximately equal to the decrease in the radiation efficiency by the influence of the shoulder.

Figure 7B:
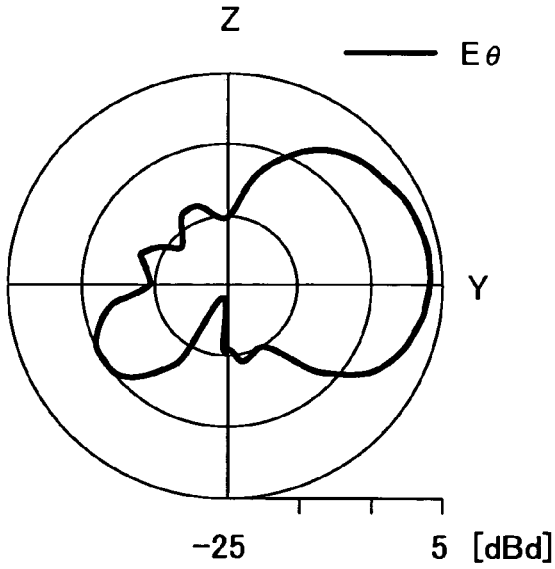
FIG. 7B illustrates a view of radiation pattern at a phase difference of 270 degrees.

Next, at the calling state where the user holds the mobile radio apparatus with the left hand, control section 201 controls phase shifter 202 based on the angle information from gravity sensor 122 so that the phase of a high frequency signal supplied to matching circuit 113 gives a 270-degree lag with respect to the phase of a high frequency signal supplied to matching circuit 115. In this case, radiation pattern is as shown in FIG. 7B, and it is possible to control directivity in +Y direction. Therefore, at the case of the calling state where the user holds the mobile radio apparatus with the left hand, it is possible to control directivity in opposite directions from the shoulder, and improve the radiation efficiency about 0.7 dB which is approximately equal to the decrease in the radiation efficiency by the influence of the shoulder.

Figure 7C:
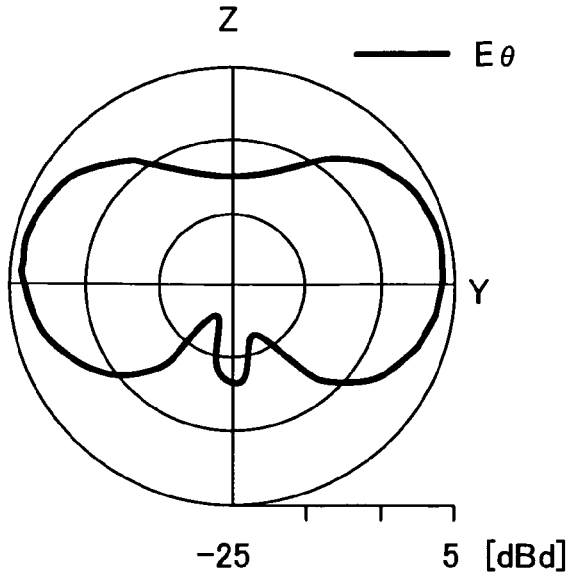
FIG. 7C illustrates a view of radiation pattern at a phase difference of 180 degrees.
Figure 7D:
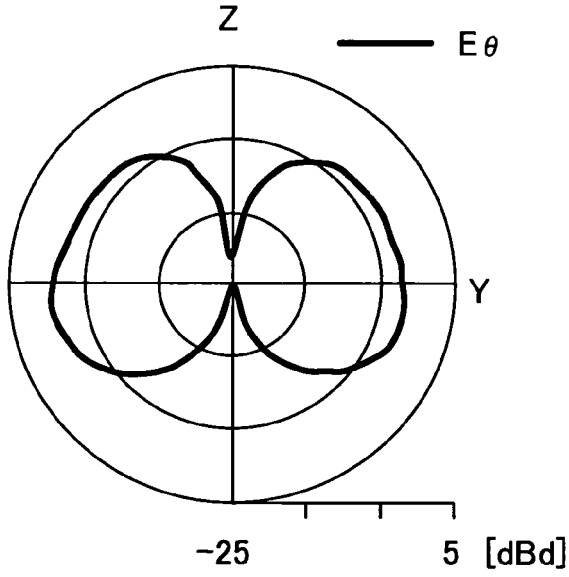
FIG. 7D illustrates a view of radiation pattern at a phase difference of 0 degree.

Furthermore, at an operating state shown in FIG. 5, for example in case that electromagnetic wave arriving in horizontal direction is high, directivity is controlled in ±Y direction as shown in FIG. 7C by setting power supplying phase difference at 180 degrees and good communication performance is achieved. Note that in case that power supplying phase difference is made 0 degree, directivity is as shown in FIG. 7D.

A mobile radio apparatus having the above configuration can realize a thin model by for example, setting flat conductor 106 and flat conductor 107 at a thickness of about 0.1 mm and placing them inside upper case 101 along rear plane of the case.

Thus, according to this embodiment, by controlling the phase difference of signals supplied to flat conductor 106 and flat conductor 107 according to the usage state, even if the usage state of a mobile radio apparatus changes during communication, it is possible to avoid causing negative impact on communication in CDMA system. In particular the influence of the shoulder decreases in the calling state, and therefore, it is possible to achieve high antenna radiation efficiency and realize a thin model.

Embodiment 3

Figure 8A:
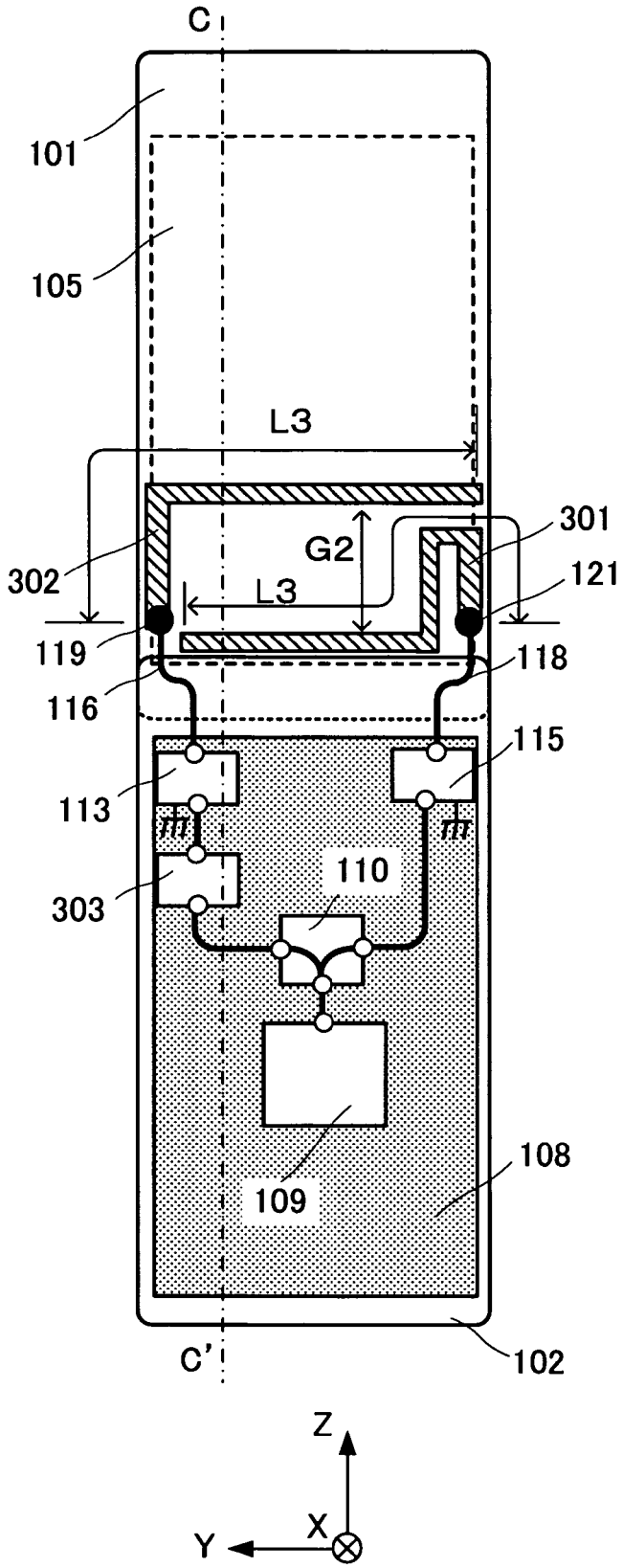
FIG. 8A is a rear view showing a configuration of the mobile radio apparatus according to Embodiment 3 of the present invention.
Figure 8B:
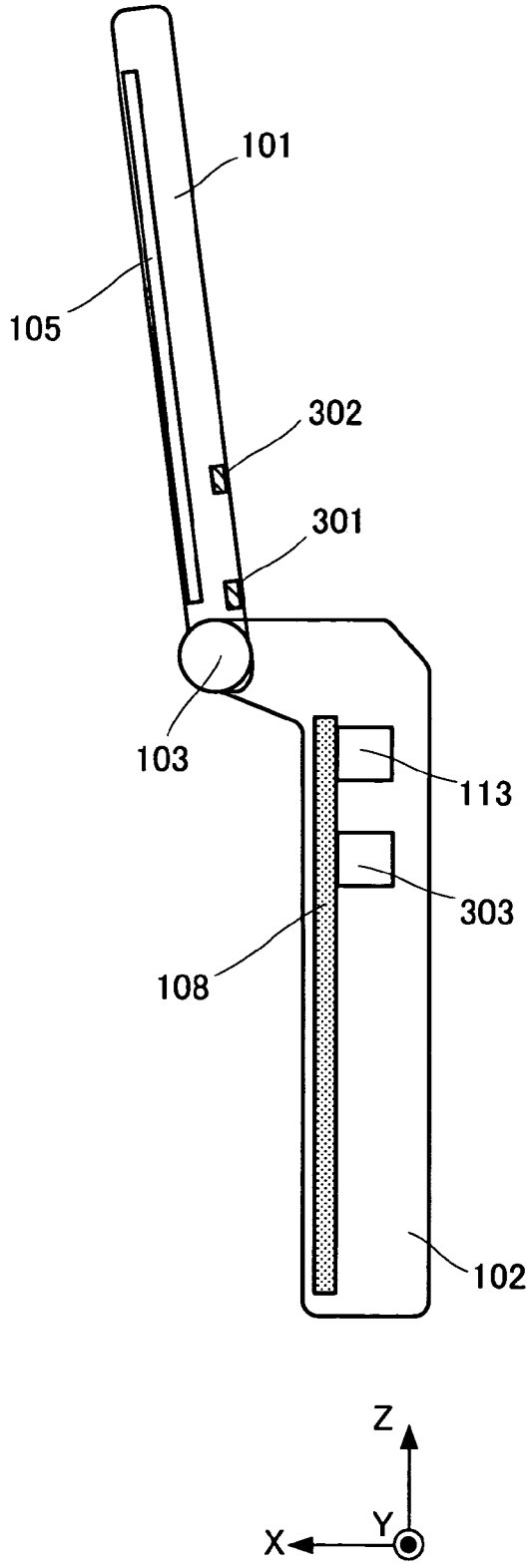
FIG. 8B is a cross sectional view showing a configuration of the mobile radio apparatus according to Embodiment 3 of the present invention.

FIG. 8A and FIG. 8B are views showing a configuration of the mobile radio apparatus according to embodiment 3 of the present invention. This figure illustrates the open state of the foldable mobile radio apparatus. FIG. 8A is a rear view of the mobile radio apparatus and FIG. 8B is C-C' cross sectional view of FIG. 8A. The same codes as FIG. 1A and FIG. 1B are assigned to parts in FIG. 8A and FIG. 8B which are common with parts in FIG. 1A and FIG. 1B, and detailed explanation thereof is omitted.

In FIG. 8A and FIG. 8B, flat conductor 301 is, for example, made of a copper plate having a length L3 of about 70 mm and width of about 3 mm, placed at the lower end of the opposite plane to display section 105 in parallel with the short side of upper case 101 inside upper case 101. In this case, as the short side of the lower end of uppercase 101 has a length of about 50 mm, flat conductor 301 folds back near power supply point 121 and maintains the length of 70 mm.

Flat conductor 302 is, for example, made of a copper plate having a length L3 of about 70 mm and width of about 3 mm, has a short part where the length from the bending part to one end is 20 mm and a long part where the length from the bending part to the other end is 50 mm. Flat conductor 302 is placed along the opposite plane to display section 105 of upper case 101 inside upper case 101, and one end of the short part has power supply point 119 at the lower end of the case, and the short part is placed along the length direction of upper case 101.

Next, antenna operation of the foldable mobile radio apparatus having the above configuration will be explained. Phase shifter 303 gives the phase of a high frequency signal supplied from power divider 110 to matching circuit 113 a 90-degree lead (or a 270-degree lag) with respect to the phase of a high frequency signal supplied to matching circuit 115 from power divider 110.

Figure 9:
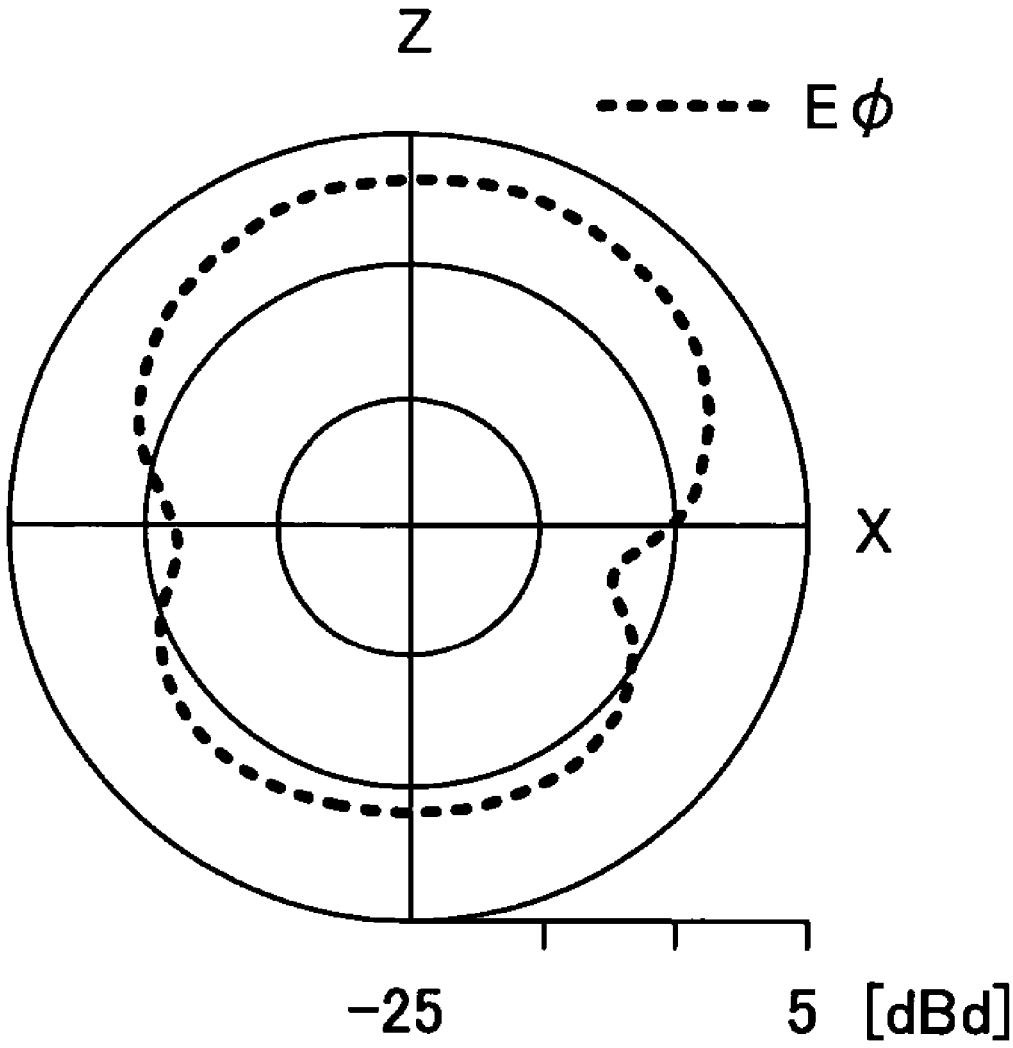
FIG. 9 illustrates a radiation pattern view of Embodiment 3 of the present invention.

In this case, radiation pattern in coordinate system of FIG. 8A and FIG. 8B is shown in FIG. 9. This figure illustrates horizontally polarized wave components (E $\phi$) on the X-Z plane. Primary polarized wave components in this case is vertically polarized wave by placing flat conductor 301 and flat conductor 302 in parallel with the short side of upper case 101, and therefore it is possible to control directivity so that a gain is high in Z direction. That is, at the calling state shown in FIG. 2 high radiation efficiency is achieved by controlling directivity in directions toward the back of the head, and the mobile radio apparatus is inclined and used so that it is possible to increase vertically polarized wave components. This makes it possible to increase effective gain at a propagation environment of land mobile communication.

Furthermore, also at the operating state shown in FIG. 5, directivity is controlled in opposite directions from thee human body, and therefore it is possible to achieve high radiation efficiency.

The mobile radio apparatus having the above configuration can realize a thin model by, for example, setting flat conductor 301 and flat conductor 302 at a thickness of about 0.1 mm and placing them along the opposite plane of display section 105 of the case inside upper case 101.

Thus, according to this embodiment, by placing L-shaped flat conductor 301 and flat conductor 302 so that the long part of the L-shape is substantially parallel to the width direction of the mobile radio apparatus, the primary polarized wave direction is in the width direction of the mobile radio apparatus, and therefore it is possible to control directivity in opposite directions from the human body, achieve high antenna radiation efficiency, realize a thinner model in various usage states.

In each embodiment as described above, a power divider/combiner is not limited to a Wilkinson power divider, and power divider having interactivity is applicable.

Furthermore, a foldable structure of the mobile radio apparatus in each embodiment described above is explained as the structure that is folded at a hinge part provided at a short side of a first case and second case, but the present invention is not limited to this and the structure that is folded at a hinge part provided on opposing planes of a first case and second case and the slide structure that a first case and second case slide each other are applicable. The point is any structure is applicable that is a mobile radio apparatus having a first case and second case.

Each embodiment described above can be used in a combination accordingly.

A first aspect of the present invention is a mobile radio apparatus that is foldable and that has a mechanism joining a first case and second case at a hinge part allowing the mobile radio apparatus to open and close, having a first flat conductor placed on a first plane inside the first case along a length direction of the first case, and a second flat conductor and third flat conductor placed on a second plane facing a first plane inside the first case along the length direction of the first case, and a power supply section that supplies power to the first flat conductor and supplies power selectively to the second flat conductor or the third flat conductor at a different phase from the phase power is supplied to the first flat conductor.

According to this configuration, by supplying power to the first flat conductor and supplying power selectively to the second flat conductor and third flat conductor at different phases from the phase power is supplied to the first flat conductor, it is possible to form directivity and therefore suppress radiation in a direction to the human body and increase antenna radiation efficiency by adjusting a phase not to direct to the human body. Furthermore, power is constantly supplied to the first flat conductor during communication, and therefore when the usage state of a mobile radio apparatus changes during communication in communication scheme that transmits consecutively, it is possible to avoid causing negative impact on communication.

A second aspect of the present invention is the mobile radio apparatus of the above described aspect, having a detecting section that detects an inclination angle of the apparatus, and a control section that controls power supply to the second flat conductor or the third flat conductor according to the inclination angle detected by the detecting section.

According to this configuration, it is possible to form directivity according to a usage state by controlling power supply to the second flat conductor or the third flat conductor according to the inclination angle, and if the usage state of a mobile radio apparatus changes during communication, it is possible to suppress radiation in a direction to the human body and improve antenna radiation efficiency.

A third aspect of the present invention is the mobile radio apparatus in the above described aspect, wherein the control section controls a phase difference between the phase power is supplied to the first flat conductor and the phase power is supplied to the second flat conductor or the third flat conductor according to the inclination angle detected by the detecting section.

According to this configuration, it is possible to form directivity according to the usage state by controlling a phase difference between the phase power is supplied to the first flat conductor and the phase power is supplied to the second flat conductor or the third flat conductor according to the inclination angle of the mobile radio apparatus, if the usage state of a mobile radio apparatus changes during communication, it is possible to suppress radiation in a direction to the human body and improve antenna radiation efficiency.

A fourth aspect of the present invention is the mobile radio apparatus in the above described aspect, having a measuring section that measures a reception level, and a mobile radio apparatus, wherein the control section controls switching between the second flat conductor and third flat conductor in case that the reception level is less than a predetermined value.

According to this configuration, it is possible to increase a possibility of improving antenna radiation efficiency by controlling switching between a second flat conductor and third flat conductor in case that the reception level is less than a predetermined value, and by switching flat conductor power is supplied to the other flat conductor in case that the user holds near the second flat conductor or the third flat conductor with a hand.

A fifth aspect of the present invention is a mobile radio apparatus that is foldable and that has a mechanism joining a first case and second case at a hinge part allowing the mobile radio apparatus to open and close, having first and second flat conductors placed on a first plane inside the first case along a length direction of the first case, and a power supply section that supplies power to the second flat conductor at a different phase from the phase power is supplied to the first flat conductor.

According to this configuration, it is possible to form directivity by supplying power to the second flat conductor at a different phase from the phase power is supplied to the first flat conductor, and therefore it is possible to suppress radiation to the human body and improve antenna radiation efficiency by adjusting a phase not to direct to the human body. Furthermore, power is constantly supplied to the first flat conductor during communication, and therefore when the usage state of the mobile radio apparatus changes during communication in communication scheme that transmits consecutively, it is possible to avoid causing negative impact on communication. In addition it is possible to promote a thinner mobile radio apparatus.

A sixth aspect of the present invention is the mobile radio apparatus in the above described aspect, wherein the first flat conductor and second flat conductor are placed so that a direction of a primary polarized wave is the same as a width direction of the first case.

According to this configuration, a first flat conductor and second flat conductor are placed so that a direction of a primary polarized wave is the same direction as a width direction of the first case, and therefore if the mobile radio apparatus is used in various states there is little possibility of radiation in a direction to the human body and it is possible to improve antenna radiation efficiency.

A seventh aspect of the present invention is a mobile radio apparatus in the above described aspect, having a detecting section that detects an inclination angle of the apparatus, and a control section that controls a phase difference between the phase power is supplied to the first flat conductor and the phase power is supplied to the second flat conductor according to the inclination angle detected by the detecting section.

According to this configuration, it is possible to form directivity according to the usage state by controlling a phase difference between the phase power is supplied to a first flat conductor and the phase power is supplied to a second flat conductor, if the usage state of a mobile radio apparatus changes during communication, it is possible to suppress radiation in a direction to the human body and improve antenna radiation efficiency.

The present application is based on Japanese Patent Application No.2003-363809 filed on Oct. 23, 2003, entire content of which is expressly incorporated by reference herein.

INDUSTRIAL APPLICABILITY

The mobile radio apparatus according to the present invention has an advantage of achieving high antenna radiation efficiency and high effective gain without causing negative impact on communication in CDMA system and realizing a thin mobile radio apparatus, and is useful to a foldable mobile telephone.

The invention claimed is:

1. A mobile radio apparatus that is foldable and that has a mechanism joining a first case and second case at a hinge part allowing said mobile radio apparatus to open and close, said mobile radio apparatus comprising:

a first flat conductor placed along one plane inside the first case, and a second flat conductor and third flat conductor placed facing the one plane of the first flat conductor and placed side by side in a width direction of the first case; and a power supply section that supplies power to the first flat conductor and supplies power selectively to the second flat conductor or the third flat conductor at a different phase from the phase power supplied to the first flat conductor.

2. The mobile radio apparatus according to claim 1, wherein the first flat conductor is a metal frame forming the first case.

3. The mobile radio apparatus according to claim 1, wherein the power supply section constantly supplies power to the first flat conductor during communication.

4. The mobile radio apparatus according to claim 1, comprising: a detecting section that detects an inclination angle of the apparatus; and a control section that controls power supply to the second fiat conductor or the third fiat conductor according to the inclination angle detected by the detecting section.

5. The mobile radio apparatus according to claim 4, wherein the control section controls a phase difference between the phase power supplied to the first flat conductor and the phase power supplied to the second flat conductor or the third flat conductor, according to the inclination angle detected by the detecting section.

6. The mobile radio apparatus according to claim 4, comprising a measuring section that measures a reception level, wherein the control section controls switching between the second flat conductor and third flat conductor when the reception level is less than a predetermined value.

* * * * *